US008225971B2

(12) United States Patent
Stark

(10) Patent No.: US 8,225,971 B2
(45) Date of Patent: Jul. 24, 2012

(54) STRAP WITH RETRIEVING COMPONENTS

(76) Inventor: Caroline S. Stark, Beachwood, OH (US)

( * ) Notice: Subject to any disclaimer, the term of this patent is extended or adjusted under 35 U.S.C. 154(b) by 389 days.

(21) Appl. No.: 12/547,584

(22) Filed: Aug. 26, 2009

(65) Prior Publication Data

US 2011/0049203 A1 Mar. 3, 2011

(51) Int. Cl.
*A45F 5/00* (2006.01)
*A45F 3/02* (2006.01)

(52) U.S. Cl. ..... 224/257; 224/255; 224/268; 224/269; 224/607; 224/621

(58) Field of Classification Search ..... 224/257, 224/255, 268, 269, 607, 621, 908, 913
See application file for complete search history.

(56) References Cited

U.S. PATENT DOCUMENTS

| | | | | | |
|---|---|---|---|---|---|
| 606,936 | A * | 7/1898 | Ottignon | 294/137 |
| 966,562 | A * | 8/1910 | Knoerzer | 224/266 |
| 2,718,988 | A * | 9/1955 | Potts | 224/609 |
| 4,483,470 | A * | 11/1984 | Cousins | 224/257 |
| 4,768,689 | A * | 9/1988 | Davis | 224/257 |
| 5,143,266 | A * | 9/1992 | Heckerman et al. | 224/150 |
| 5,370,286 | A * | 12/1994 | Newman | 224/578 |
| 5,667,266 | A * | 9/1997 | Giocanti | 294/170 |
| 5,806,733 | A * | 9/1998 | Smith | 224/264 |
| 5,894,972 | A * | 4/1999 | Brown | 224/267 |
| D410,386 | S * | 6/1999 | Watkins | D9/434 |
| 6,045,019 | A * | 4/2000 | Moses | 224/257 |
| D457,725 | S * | 5/2002 | Parsons | D3/327 |
| 6,446,849 | B1 * | 9/2002 | Schleifer | 224/258 |
| 6,499,781 | B1 * | 12/2002 | Flynn | 294/159 |
| 6,651,941 | B1 * | 11/2003 | Kinsel | 248/100 |
| D508,323 | S * | 8/2005 | Douglas | D3/328 |
| D528,413 | S * | 9/2006 | Baum | D9/434 |
| 7,377,568 | B2 * | 5/2008 | Moses | 294/170 |
| 2009/0032559 | A1 * | 2/2009 | Fragale | 224/255 |

* cited by examiner

*Primary Examiner* — Nathan J Newhouse
*Assistant Examiner* — Lester L Vanterpool
(74) *Attorney, Agent, or Firm* — Howard M. Cohn

(57) ABSTRACT

A strap with retrieving components includes an elongated strip of flexible material having a central portion extending along a longitudinal axis there through. The retrieving components are secured at opposite ends of the central portion of flexible material and comprise first and second rigid, hook shaped components, each secured at opposite ends of the central portion of flexible material so that the first and second hooked shaped components are disposed in a plane through the central portion of the strip of flexible material. Each of the first and second hook shaped components are curved in opposite directions from the longitudinal axis so that a free end of the first hooked shaped component extends in an opposite direction from a free end of the second hooked shaped component.

19 Claims, 2 Drawing Sheets

STRAP WITH RETRIEVING COMPONENTS

TECHNICAL FIELD OF THE INVENTION

The present invention relates generally to a strap specifically designed to pickup or carry objects, and more particularly to a strap having a hook at either end.

BACKGROUND OF THE INVENTION

It is a major problem for the aged or handicapped to pick up objects which are out of reach, whether on the floor or on a shelf. Many elderly or handicapped people are confined to wheelchairs or in bed and cannot move sufficiently to reach objects even on their own level. They often lack sufficient strength in their hands to properly grip an item, even if they could pick it up otherwise. Further, healthy otherwise individuals may have difficulty in stooping, bending, reaching, twisting, or stretching to retrieve objects and articles that are on the floor or ground. There are situations where a healthy person is driving a vehicle and is unable to reach something not within arm's reach in a safe and practical manner.

Further, it is common to observe a great number of people who, on a daily basis, carry their grocery bags, shopping bags, packages and the like under great duress by hand. Often, the handle of these bags are made of the flimsy plastic sheet material of the bag and do not retain their shape, but conform to the shape of the customers' hands. Where the contents of a bag is heavy, there is considerable localized pressure across the customers hands. This puts a burden on the fingers, strains the muscles of the wrists and arms, and ties up both hands making it very difficult to hold a banister, use stairs or open and close doors. Furthermore, it is not uncommon that the individual already has a hand tied up, for example, the professional holding an attaché case, the student loaded with books, or the elderly leaning on a cane.

The present invention seeks to alleviate these issues.

ASPECTS AND SUMMARY OF THE INVENTION

It is an aspect of the present invention to provide a strap with retrieving components to reach something in a safe and practical manner.

It is another aspect of the present invention to provide a strap with retrieving components to carry heavy bags over a shoulder.

It is yet another aspect of the present invention to provide a strap with retrieving components to retrieve objects and articles that are on the floor or ground without stooping, bending, reaching, twisting, or stretching.

According to the present invention there has been disclosed a strap with retrieving components which includes an elongated strip of flexible material including a central portion extending along a longitudinal axis there through. The retrieving components are secured at opposite ends of the central portion of flexible material. The retrieving components comprise first and second rigid, hook shaped components, each secured at opposite ends of the central portion of flexible material so that the first and second hooked shaped components are disposed in a plane through the central portion of the strip of flexible material. Each of the first and second hook shaped components are curved in opposite directions from the longitudinal axis so that a free end of the first hooked shaped component extends in an opposite direction from a free end of the second hooked shaped component.

Further according to the present invention, the first and second hooked shaped elements are formed of rigid plastic or metal.

Still further according to the present invention, the flexible material of the strap is plastic such as polyethylene.

Yet further according to the present invention, the longitudinal axis is an axis of symmetry through the strap and the first and second rigid, hook shaped components.

Also according to the present invention, the strap includes a central portion having lateral edges and which is dimensioned and configured to be gripped by the hand or to rest on a human shoulder and extend to each side thereof.

According to the present invention, the central portion of the strap has a flat, textured surface to prevent slipping when carried by hand or supported on a shoulder.

Further according to the present invention, the first and second rigid, hook shaped components are generally U-shaped hooks.

Yet further according to the present invention, the first and second rigid, hook shaped components are disposed on opposite sides of the longitudinal axis.

Moreover according to the present invention, the first and second rigid, hook shaped components each have a first connector section formed with a slot to receive end portions of the strap. The first connector section extends away from the strap in the direction of the longitudinal axis. Also, the first and second rigid, hook shaped components each have a second connector section which are connected at one end to their respective first connector sections. The second connector sections each extend along the longitudinal axis and in opposite directions from each other.

Also according to the present invention, the first and second rigid, hook shaped components each have a third connector section connected at one end to the outer end of their second connector section. The third connector sections each have an inner surface formed within the inner curvature of the first and second hook components. The third connector sections each have a third end portion that extends in the direction of the longitudinal axis, the third end portion having a first end portion connected to its respective second connector section and a free end.

Yet further according to the present invention, the free end of the third connector sections face each other and are disposed on opposite sides of the longitudinal axis. Also, the third end portions are spaced from the first connector sections a distance to form hook-like opposed lateral openings which form the hooking structure of first and second hooking components.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

DETAILED DESCRIPTION OF THE PREFERRED EMBODIMENTS

Figure 1:
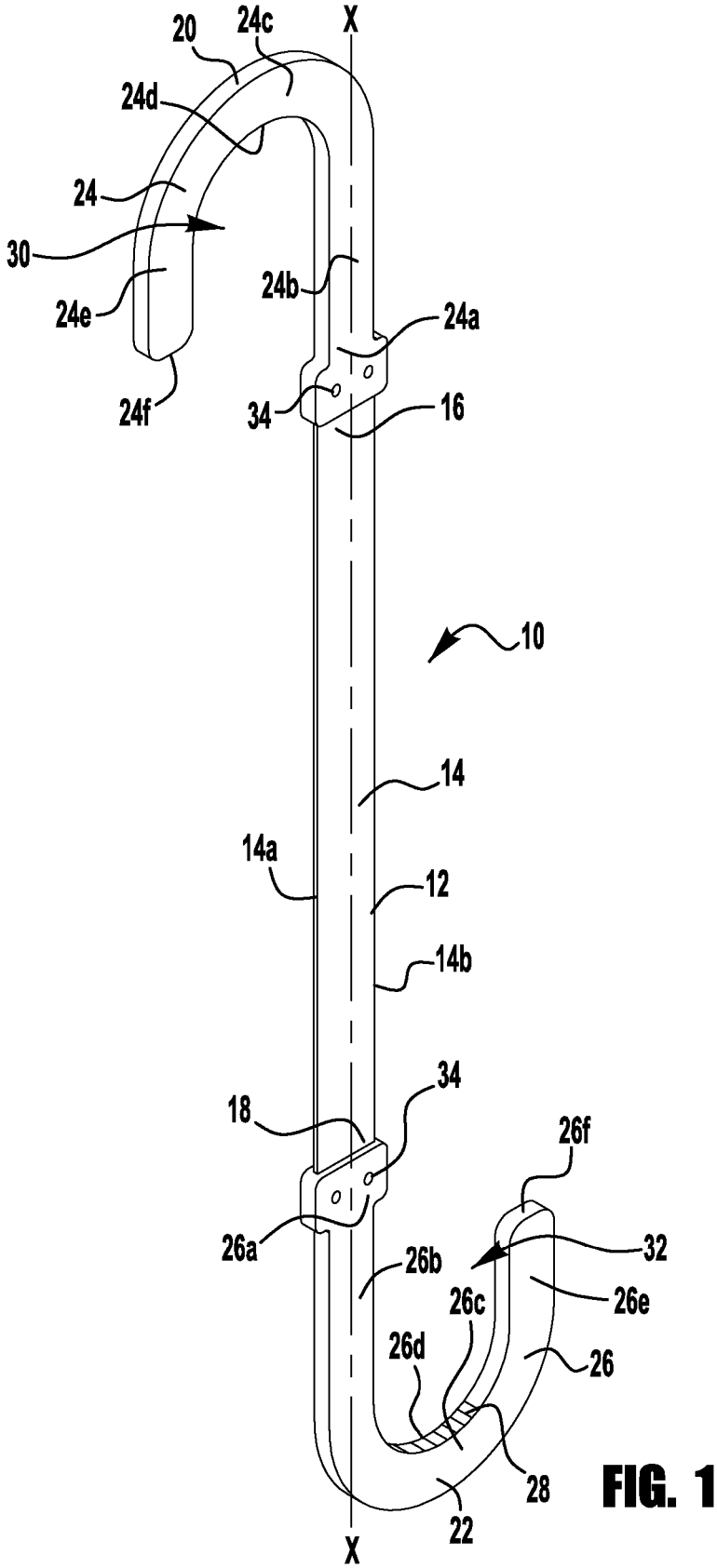
FIG. 1 is an orthogonal view of the strap with hooks at opposite ends, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Referring now to FIG. 1, there is shown the strap 10 with retrieving means 20,22 for picking up objects at opposite ends thereof. The strap 12 can be a thin, narrow strip or band of any suitable plastic, such as polyethylene or other flexible material such as leather having a length of about 36 to 48 inches and a width of between about 1 and 2 inches. However, the size of the strap can be varied, depending on the size of the user.

The strap 12 is generally elongate and defines a longitudinal axis x-x. The axis x-x can be an axis of symmetry. The strap 12 includes a central portion 14 having lateral edges 14*a*, 14*b* and which is dimensioned and configured to be gripped by the hand or to rest on a human shoulder and extend to each side thereof. Moreover, the strap can have a textured surface to prevent slipping when it is being held by hand or placed over a shoulder.

Figure 2:
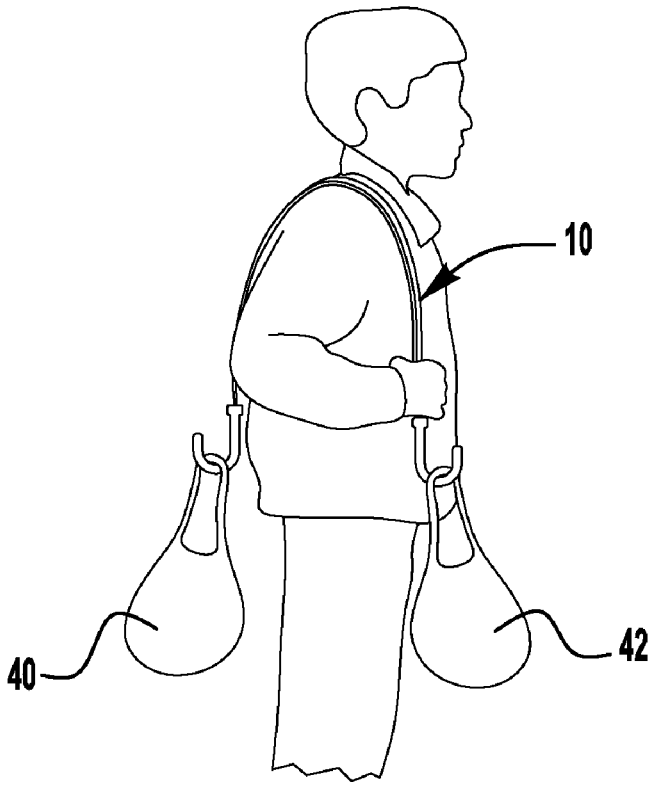
FIG. 2 is a view of a person carrying two bags across the shoulder using the strap with hooks, in accordance with the present invention.

As illustrated in FIG. 2, the strap 10 is shown as it could normally be used to support at least two bags 20 and 22 on a shoulder. The axial length of the strap 12 is not critical although the length should be selected to position the bags being carried at a comfortable height at the front and rear of the user. It has been found, for example, that an overall length of about 45 inches is suitable, although different lengths may be used to accommodate the size and/or height of the user.

In the broadest aspects of the invention the central portion 14 of strap 12 is provided at opposite ends 16 and 18 thereof with retrieving means or retrieving components 20 and 22, respectively, for engaging and retaining, for example, a handle formed in any type of object, such as a briefcase or a hand bag. The retrieving means 20, 22 are generally U-shaped hooks 24, 26, respectively, but can take any form which will suitably attach to a handle or any other projection on an object which lends itself to being hooked so that the object can be lifted and moved. In the present invention, the hooking means 20, 22 are disposed on opposite sides of the axis X-X, at each end portion 16, 18, which receive the handles.

As shown in FIG. 1, each of the end portions 16, 18 of the strap 12 has the hooking means 20 and 22, respectively, secured thereto by and conventional means such as for example sewing or gluing them. Each of the hooks 24 and 26 is preferably formed of a rigid material, such as plastic or metal. The hooks 24 and 26 can have any desired thickness preferably less than 0.5 inch and most preferably about 0.25 inch. Each of the hooks 24 and 26 are constructed with a first connector section 24*a*, 26*a* which are connected at one end to the end portions 16, 18, respectively, of the strap 12. The first connector section 24*a*, 26*a* can be formed with a slot adapted to receive the end portions 16, 18, respectively of the strap 12. Then, the strap can be secured in the slot by conventional means such as glue or by heat. It is also within the terms of the invention to provide holes 34 extending through the first connector section 24*a*, 26*a* to enable the hook to be secured to the strap by means such as sewing. The first connector section 24*a*, 26*a* extends away from the strap 12 in the direction of the x-x axis.

The hooks 24 and 26 further have a second connector section 24*b*, 26*b* which are connected at one end to the first connector section 24*a*, 26*a*, respectively. The second connector section 24*b*, 26*b* each extend along the x-x axis and in opposite directions from each other.

A third connector section 24*c*, 26*c* are connected at one end to the outer end of the second connector section 24*b*, 26*b* and each have an opposite end extending away and spaced from the x-x axis and in opposite directions from each other. The third connector sections 24*c*, 26*c* each have an inner surface 24*d*, 26*d* formed within the inner curvature of the hook 24, 26, respectively, that forms the surface that receives the handle or other protrusion from the object being picked up. The inner surface 24*d*, 26*d* can have means such as grooves 28 to reduce any tendency for the handle to slide around once it's disposed on the hook.

A third end portion 24*e*, 26*e* of hooks 24 and 26, respectively, extends generally in the direction of the x-x axis and has a first end portion connected to the second connector section 24*c*, 26*c* and a free end 24*f*, 26*f* facing each other but on opposite sides of the x-x axis. The third end portion 24*e*, 26*e* is spaced from the first connector section 24*b*, 26*b* a distance to form hook-like opposed lateral openings or cutouts 30, 32 which form the hooking structure of hooking means 20, 22. The size of the hooking means 20, 22 can be varied.

Referring to FIG. 2, there is illustrated a view of a person carrying two bags 40, 42 across the shoulder using the strap with hooks 10, in accordance with the present invention.

Figure 3:
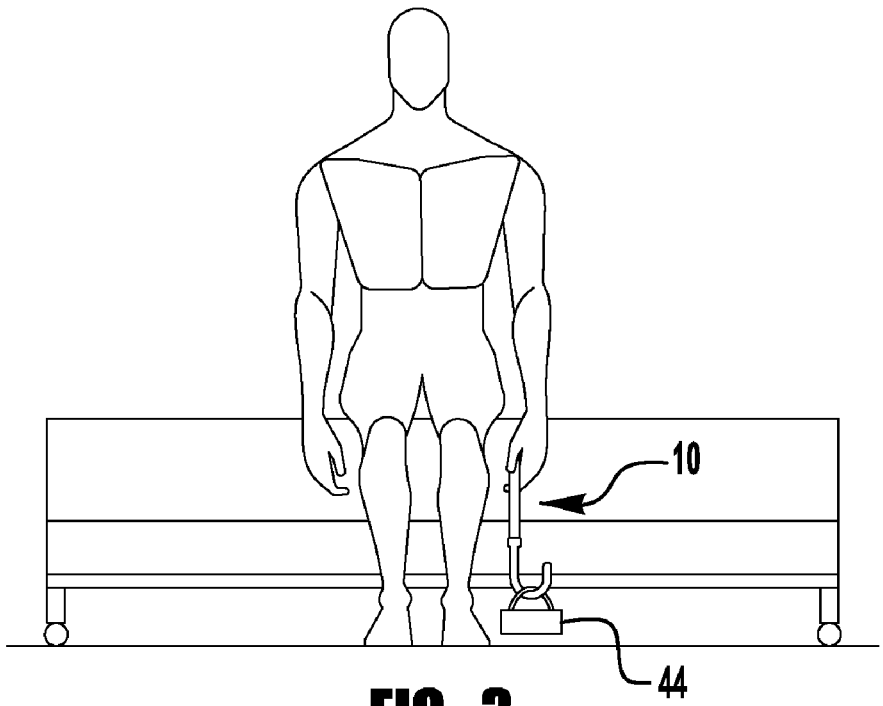
FIG. 3 is a view of a person on a bed using the strap with hooks, in accordance with the present invention, to pick up something from the floor.

Referring to FIG. 3, there is illustrated a view of a person carrying two bags 40, 42 across the shoulder using the strap with hooks 10, in accordance with the present invention.

It is also understood, of course, that while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed. Thus, the scope of the invention should be determined by the appended claims and their legal equivalents, rather than solely by the examples given.

The invention claimed is:

1. A strap with retrieving components, comprising:

an elongated strip of flexible material including a central portion extending along a longitudinal axis there through;

the retrieving components secured at opposite ends of said central portion of flexible material;

the retrieving components comprising first and second rigid, hook shaped components, each secured at opposite ends of the central portion of flexible material so that the first and second hooked shaped components are disposed in a plane through the central portion of the strip of flexible material; and each of the first and second hook shaped components being generally U-shaped, rigid and curved in opposite directions from the longitudinal axis which is an axis of symmetry through the strap of flexible material and the first and second rigid, hook shaped components so that a free end of the first hooked shaped component extends in an opposite direction from a free end of the second hooked shaped component.

2. The strap as defined in claim 1, wherein the first and second hooked shaped components are formed of metal.

3. The strap as defined in claim 1, wherein said strap includes a central portion having lateral edges and which is dimensioned and configured to be gripped by the hand or to rest on a human shoulder and extend to each side thereof.

4. The strap as defined in claim 3, wherein said central portion of the strap has a flat, textured surface to prevent slipping when carried by hand or supported on a shoulder.

5. The strap as defined in claim 1, wherein the first and second rigid, hook shaped components are formed of a rigid material, selected from the group comprising plastic and metal.

6. The strap as defined in claim 1, wherein the first and second rigid, hook shaped components have a first connector section formed with a slot to receive end portions of the strap.

7. The strap as defined in claim 6, wherein the first connector section extends away from the strap in the direction of the longitudinal axis.

8. The strap as defined in claim 7, wherein the first and second rigid, hook shaped components each have a second connector section which are connected at one end to their respective first connector sections.

9. The strap as defined in claim 8, wherein the second connector sections each extend along the longitudinal axis and in opposite directions from each other.

10. The strap as defined in claim 9, wherein the first and second rigid, hook shaped components each have a third connector section connected at one end to the outer end of their second connector section.

11. The strap as defined in claim 10, wherein the third connector sections each have an inner surface formed within the inner curvature of the first and second hook components.

12. The strap as defined in claim 11, wherein the third connector sections each have a third end portion that extends in the direction of the longitudinal axis, the third end portion having a first end portion connected to its respective second connector section and a free end.

13. The strap as defined in claim 12, wherein the free end of the third connector sections face each other and are disposed on opposite sides of the longitudinal axis.

14. The strap as defined in claim 12, wherein the third end portions are spaced from the first connector sections a distance to form hook-like opposed lateral openings which form the hooking structure of first and second hooking components.

15. A strap with retrieving components, comprising:

an elongated strip of flexible material including a central portion extending along a longitudinal axis there through;

the retrieving components secured at opposite ends of said central portion of flexible material;

the retrieving components comprising first and second rigid, hook shaped components, each secured at opposite ends of the central portion of flexible material so that the first and second hooked shaped components are disposed in a plane through the central portion of the strip of flexible material; and each of the first and second hook shaped components being rigid and curved in opposite directions from the longitudinal axis which is an axis of symmetry through the strap of flexible material and the first and second rigid, hook shaped components so that a free end of the first hooked shaped component extends in an opposite direction from a free end of the second hooked shaped component; and wherein the first and second hooked shaped components are formed of rigid plastic.

16. The strap as defined in claim 15, wherein said flexible material comprises plastic.

17. The strap as defined in claim 16, wherein the flexible plastic material comprises polyethylene.

18. The strap as defined in claim 15, wherein the first and second rigid, hook shaped components are generally U-shaped hooks.

19. The strap as defined in claim 15, wherein the first and second rigid, hook shaped components are disposed on opposite sides of the longitudinal axis.

* * * * *